US008322090B2

(12) United States Patent
Moriya et al.

(10) Patent No.: US 8,322,090 B2
(45) Date of Patent: Dec. 4, 2012

(54) THERMALLY EFFICIENT WINDOW ASSEMBLY

(75) Inventors: Masanori Moriya, Dublin, GA (US); John Uhl, Tampa, FL (US); Tsutomu Ito, Marietta, GA (US); Richard Braunstein, Marietta, GA (US)

(73) Assignee: YKK Corporation of America, Marietta, GA (US)

( * ) Notice: Subject to any disclaimer, the term of this patent is extended or adjusted under 35 U.S.C. 154(b) by 544 days.

(21) Appl. No.: 12/352,986

(22) Filed: Jan. 13, 2009

(65) Prior Publication Data

US 2010/0175339 A1 Jul. 15, 2010

(51) Int. Cl.
*E06B 7/00* (2006.01)

(52) U.S. Cl. ..... 52/204.591; 52/204.593; 52/204.6; 52/204.7

(58) Field of Classification Search ..... 52/204.591, 52/204.593, 204.5, 204.597, 204.6, 204.7; 49/501, 504, DIG. 1
See application file for complete search history.

(56) References Cited

U.S. PATENT DOCUMENTS

| | | | | |
|---|---|---|---|---|
| 3,012,642 | A * | 12/1961 | Emmerich | 52/204.597 |
| 3,203,053 | A * | 8/1965 | Lane et al. | 52/212 |
| 3,487,580 | A * | 1/1970 | Holliday | 49/372 |
| 4,024,690 | A * | 5/1977 | Collins et al. | 52/204.591 |
| 4,079,772 | A | 3/1978 | Klaenhammer et al. | |
| 4,312,905 | A * | 1/1982 | Kreusel | 428/122 |
| 4,524,112 | A * | 6/1985 | Willert | 428/595 |
| 4,614,062 | A * | 9/1986 | Sperr | 49/504 |
| 4,640,054 | A * | 2/1987 | Breimeier et al. | 49/504 |
| 5,038,537 | A * | 8/1991 | Frambach | 52/207 |
| 5,622,017 | A | 4/1997 | Lynn et al. | |
| 5,768,836 | A * | 6/1998 | Bachmann | 52/204.51 |
| 6,035,596 | A * | 3/2000 | Brunnhofer | 52/404.1 |
| 6,202,353 | B1 * | 3/2001 | Giacomelli | 49/504 |
| 6,223,414 | B1 | 5/2001 | Hodek et al. | |
| 6,401,428 | B1 | 6/2002 | Glover et al. | |

(Continued)

FOREIGN PATENT DOCUMENTS

DE 2115154 * 10/1972

(Continued)

OTHER PUBLICATIONS

Be Sicherheitssysteme (Schuco) Company Brochure, pp. 1-12, available at least as early as Apr. 2008.*

Be—Aluminium Fenster Company Brochure, pp. 1-8, available at least as early as Apr. 2008.*

*Primary Examiner* — Brian Glessner
*Assistant Examiner* — Adam Barlow
(74) *Attorney, Agent, or Firm* — Kilpatrick Townsend & Stockton LLP

(57) ABSTRACT

A window assembly according to various embodiments includes a frame, a sash, an insulating unit (e.g., one or more glass panels), a glass stop, an elongated frame insulating element slidably disposed on an inner surface of the frame, an elongated sash insulating element slidably disposed on an outer surface of the sash, and an elongated inner sash insulating element slidably disposed on an inner surface of the sash. The elongated frame insulating element, the elongated sash insulating element, and the elongated inner sash insulating element each define a plurality of chambers that extend substantially parallel to a longitudinal axis of each element. These chambers reduce the size of the space between the frame and sash and the size of the space between the sash, the insulating unit, and the glass stop, which results in smaller convection currents within these spaces and a more thermally efficient window assembly.

14 Claims, 7 Drawing Sheets

U.S. PATENT DOCUMENTS

| | | | | |
|---|---|---|---|---|
| 7,096,640 | B1 | 8/2006 | Chevian et al. | |
| 7,182,119 | B2 | 2/2007 | Woodward et al. | |
| 2006/0260227 | A1* | 11/2006 | Winfield | 52/204.593 |
| 2007/0289231 | A1 | 12/2007 | Nevins | |
| 2008/0196342 | A1 | 8/2008 | Franklin | |

FOREIGN PATENT DOCUMENTS

| | | | |
|---|---|---|---|
| DE | 2130496 | * | 12/1972 |
| DE | 2412317 | * | 9/1974 |
| DE | 2531267 | * | 1/1977 |
| GB | 2 402 697 A | | 12/2004 |

* cited by examiner

THERMALLY EFFICIENT WINDOW ASSEMBLY

BACKGROUND OF THE INVENTION

In general, an operable window assembly includes a sash, frame, and one or more glass panels (e.g., monolithic glass or insulating units having two or more glass panels). The one or more glass panels are mounted within the sash adjacent the inner surface of the sash, and the sash is mounted within the frame adjacent the inner surface of the frame. The frame is then mounted into an opening of a building such that the outer surface of the frame is adjacent a wall of the building that defines the opening. The sash and frame may include hollow chambers extending longitudinally within the sash and the frame, and heat differentials between the exterior surfaces of the sash and frame and the interior surfaces of the sash and frame generate convection currents of air between the sash and frame and within the hollow chambers. These convection currents transfer heat from the warmer portions of the sash and frame to the cooler portions of the sash and frame, which can reduce the thermal efficiency of the window assembly. In addition, heat is transferred between the exterior of the sash and frame and the interior of the sash and frame through conduction and radiation. For example, heat is transferred via conduction between the one or more glass panels and the sash (or frame) and between the interior and exterior portions of the sash or frame and any thermal breaks joining these portions.

Therefore, there is a need in the art to provide a more thermally efficient window assembly.

BRIEF SUMMARY OF VARIOUS EMBODIMENTS OF THE INVENTION

Various embodiments of an operable window assembly include a frame, a sash, and at least one elongated frame insulating element that is formed separately from the frame. The frame has an inner surface, and the inner surface defines a track that extends outwardly from the inner surface. The track defines a retaining channel along a longitudinal axis of the track. The sash has an outer surface, and the sash is mounted within the frame such that the outer surface of the sash is disposed opposite to and cofaces the inner surface of the frame. The at least one elongated frame insulating element includes a frame engaging protrusion that extends outwardly from a first surface of the at least one elongated frame insulating element, and the frame engaging protrusion is slidably disposed within the retaining channel. In addition, the at least one elongated frame insulating element defines a plurality of chambers that extend substantially parallel to a longitudinal axis of the at least one elongated frame insulating element. The chambers reduce the size of the space between the frame and the sash, and reducing the size of the space reduces the size of the convection currents that may form between the frame and sash, which reduces the amount of heat transferred through convection. In addition, in one embodiment, the elongated frame insulating element is formed of a material having low thermal conductivity relative to the thermal conductivity(s) of the material(s) from which the frame and sash are formed, which reduces the heat transferred through conduction between the sash and the frame and portions of each.

In one embodiment, the outer surface of the sash defines a second track that extends outwardly from the outer surface of the sash, and the second track defines a second retaining channel along a longitudinal axis of the second track. The window assembly further includes at least one elongated sash insulating element formed separately from the sash. The elongated sash insulating element includes a sash engaging protrusion that extends outwardly from a first surface of the elongated sash insulating element, and the sash engaging protrusion is slidably disposed within the second retaining channel. The elongated sash insulating element also defines a plurality of chambers that extend substantially parallel to a longitudinal axis of the elongated sash insulating element.

Furthermore, the elongated frame insulating element includes a second surface that is spaced apart from and opposite its first surface, and the elongated sash insulating element includes a second surface that is spaced apart from and opposite its first surface. When the sash is disposed within the frame in a closed position, the second surface of the elongated sash insulating element and the second surface of the elongated frame insulating element are disposed adjacent to and substantially cofacing each other. In a particular embodiment, the second surfaces at least partially engage each other. The arrangement of the elongated sash insulating element and the elongated frame insulating element further reduces the size of the space between the sash and the frame, which reduces the size of convection currents that may form between the sash and the frame.

In a further embodiment, the frame defines at least one chamber between the interior surface and the exterior surface of the frame, and the sash defines at least one chamber between the interior surface and the exterior surface of the sash. An elongated foam member is disposed within the chamber of the frame, and another elongated foam member is disposed within the chamber of the sash. The elongated foam members further reduce the size of the space within the chamber in which convection currents can form, which increases the thermal efficiency of the window assembly.

Furthermore, in an embodiment in which the interior and exterior surfaces of the sash and frame are formed of aluminum or other materials having relatively high thermal conductivity, the thickness of the exterior surfaces may be decreased and the thickness of the interior surfaces may be increased, which causes the interior surfaces to act as a heat sink. In particular, the increased mass of the interior surfaces slows the rate of heat transferred through the interior surfaces, thus further increasing the thermal efficiency of the window assembly.

An alternative embodiment of the invention includes a fixed frame inoperable window assembly that includes a frame, at least one glass panel, a glass stop, and at least one elongated frame insulating element. The frame has an inner surface, and the inner surface has a first portion that defines a track extending outwardly from the inner surface. The track defines a retaining channel along a longitudinal axis of the track. The glass stop is disposed adjacent a second portion of the inner surface of the frame and the at least one glass panel, and the at least one glass panel is disposed adjacent a third portion of the inner surface of the frame. The first portion of the inner surface of the frame is disposed between the second portion and the third portion. The at least one elongated frame insulating element is formed separately from the frame and includes a frame engaging protrusion that extends outwardly from a first surface of the at least one elongated frame insulating element. The frame engaging protrusion is slidably disposed within the retaining channel. The at least one elongated frame insulating element defines a plurality of chambers that extend substantially parallel to a longitudinal axis of the at least one elongated frame insulating element, and a second surface of the at least one elongated frame insulating element that is opposite and spaced apart from the first surface of the at least one elongated frame insulating element is opposite and cofaces at least a portion of the glass stop.

In another embodiment of the invention, a window assembly comprises a frame having an interior portion and an exterior portion, and the interior portion includes an interior surface that faces an interior area of a building in which the window assembly is installed. The exterior portion includes an exterior surface that faces an exterior area of the building. The interior portion defines a chamber that extends therethrough along a longitudinal axis of the interior portion. The interior surface has a first thickness, and the exterior surface has a second thickness that is less than the first thickness. In a further embodiment, the frame also includes a thermal break portion that extends between the interior portion and the exterior portion, and the thermal break portion is formed of a material having a thermal conductivity that is less than the thermal conductivity of the material from which the frame is formed.

For example, in a particular embodiment, the thickness of the interior surface of the frame is about 35% greater than the thickness of the exterior surface of the frame. By increasing the thickness of the interior surface, the interior surface acts as a heat sink during cooler months—storing radiant heat received through the glass panel and any heat transferred to the interior surface through conduction or convection from the exterior surface. Because the convection currents in the interior area of the building can be significantly larger than the convection currents that may form in the chamber(s) between the interior surface and the exterior surface, less of the heat stored in the interior surface is released to the exterior area of the building. According to one embodiment, this arrangement increases the thermal performance of the window assembly during the cooler months.

BRIEF DESCRIPTION OF THE DRAWINGS

Figure 1:
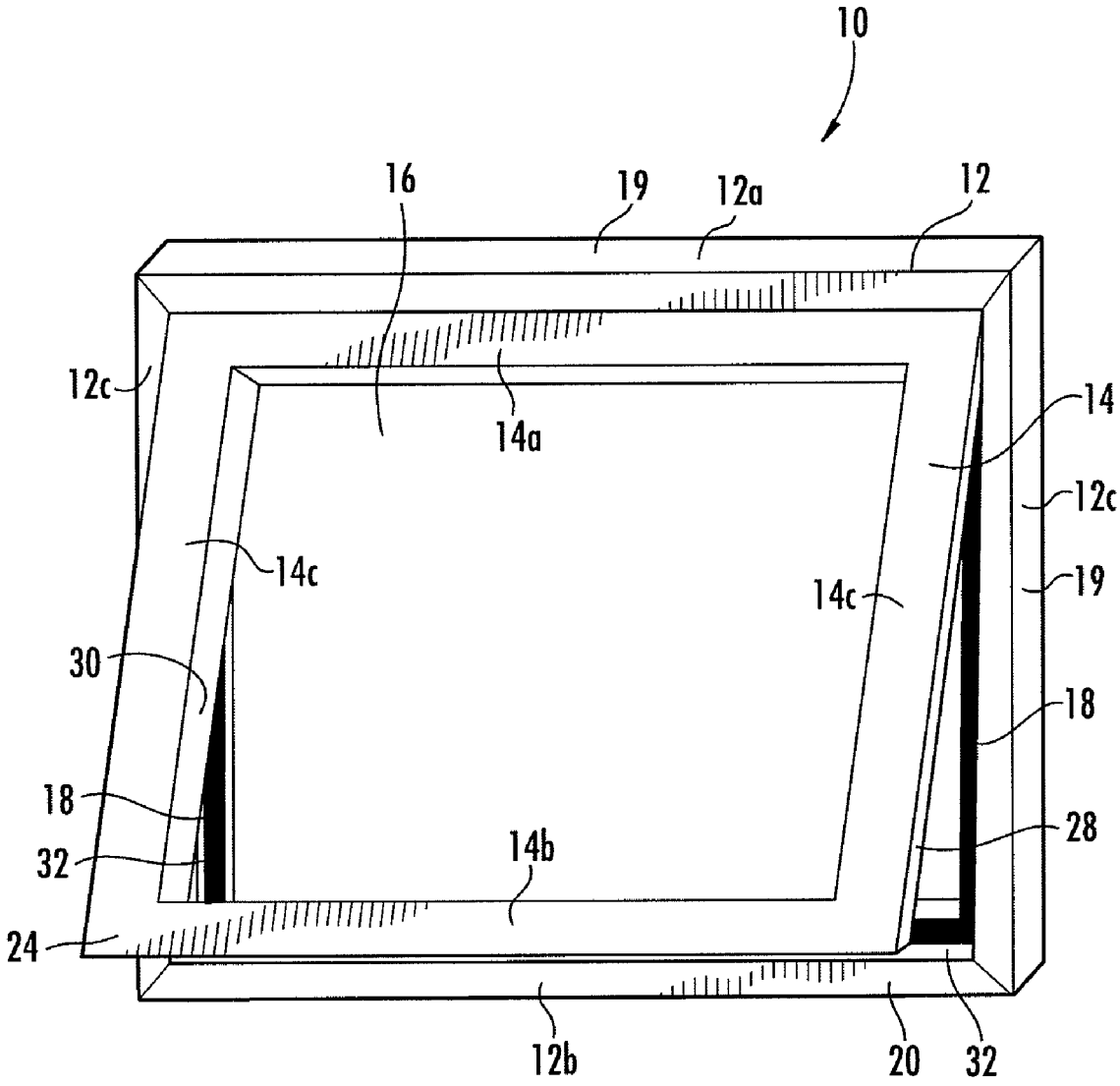

Having thus described various embodiments of the invention in general terms, reference will now be made to the accompanying drawings, which are not necessarily drawn to scale, and wherein:

FIG. 1 illustrates a perspective view of an operable window assembly according to one embodiment of the invention that includes a sash and a frame, wherein the frame is in an open position.

Figure 2:
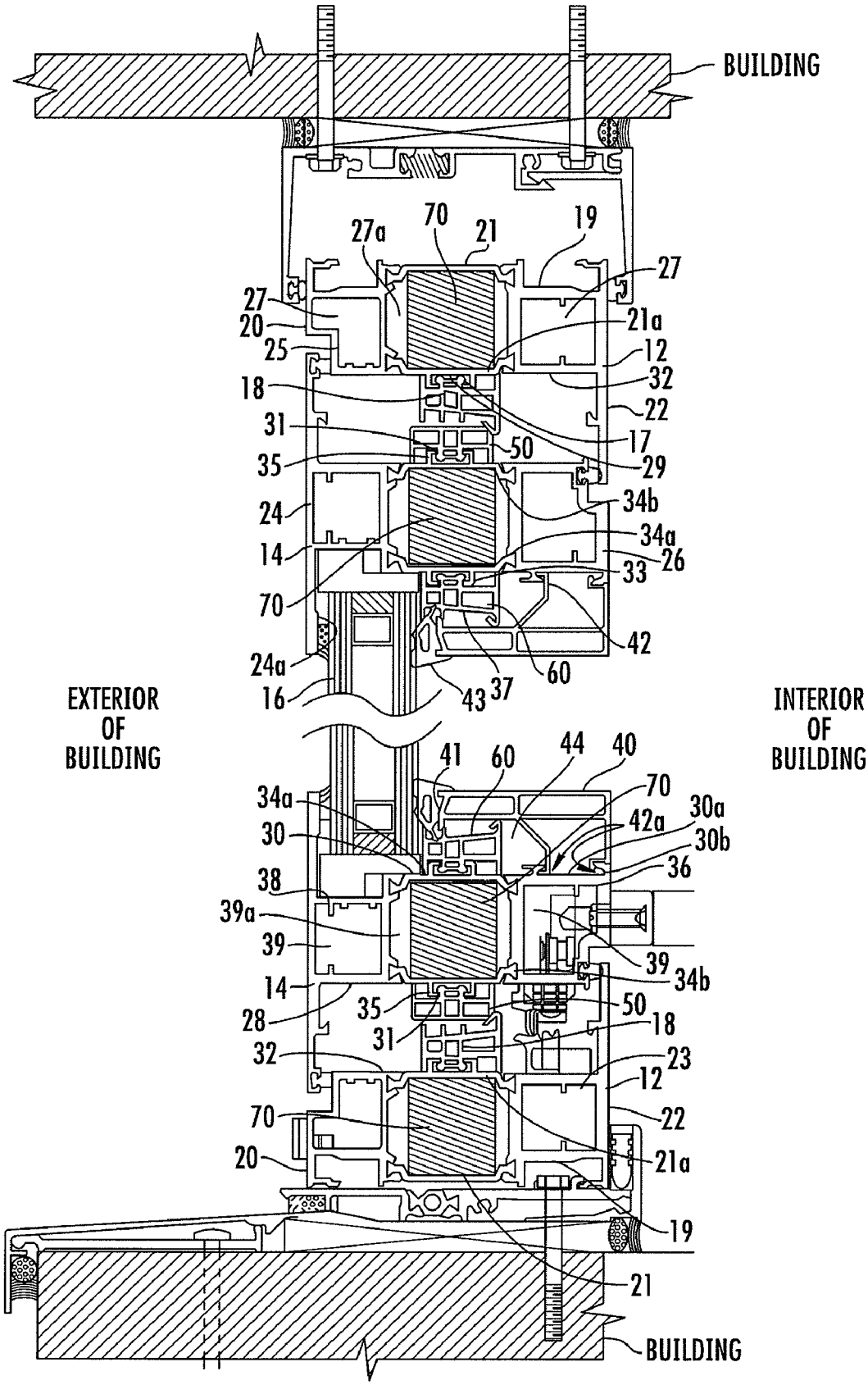

FIG. 2 illustrates a cross sectional view of the window assembly shown in FIG. 1, wherein the window assembly is in a closed position.

Figure 3:
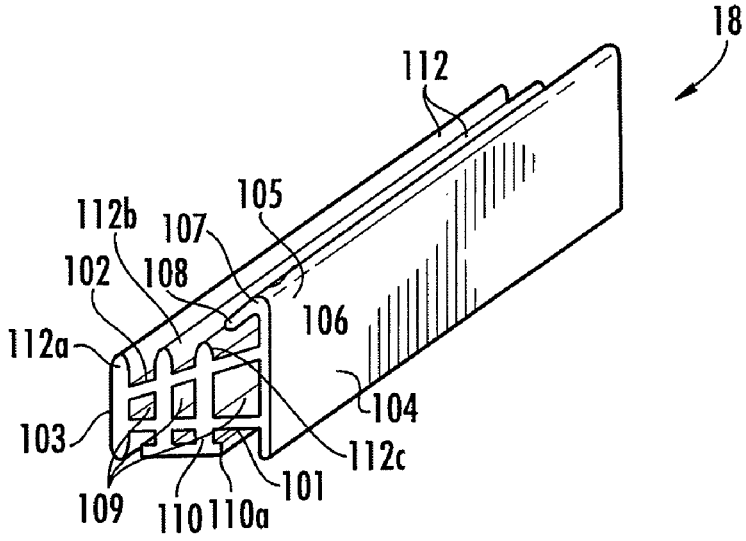

FIG. 3 illustrates a perspective view of a frame insulating element shown in FIG. 2.

Figure 4:
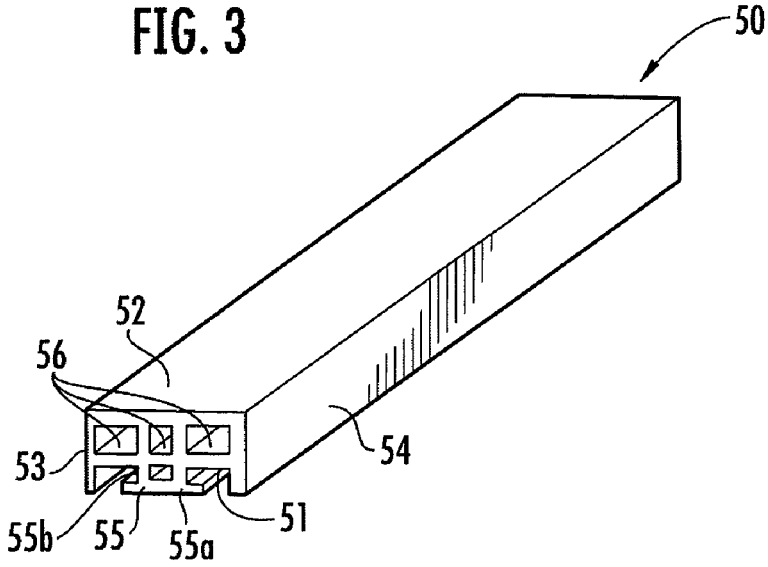

FIG. 4 illustrates a perspective view of an elongated sash insulating element shown in FIG. 2.

Figure 5:
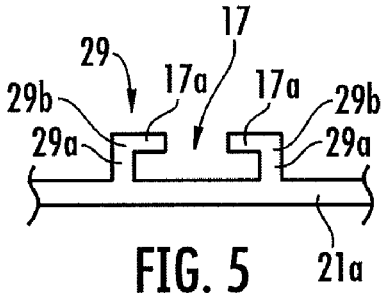

FIG. 5 illustrates an end view of the track and retaining channel defined by the inner surface of a frame shown in FIG. 2.

Figure 6:
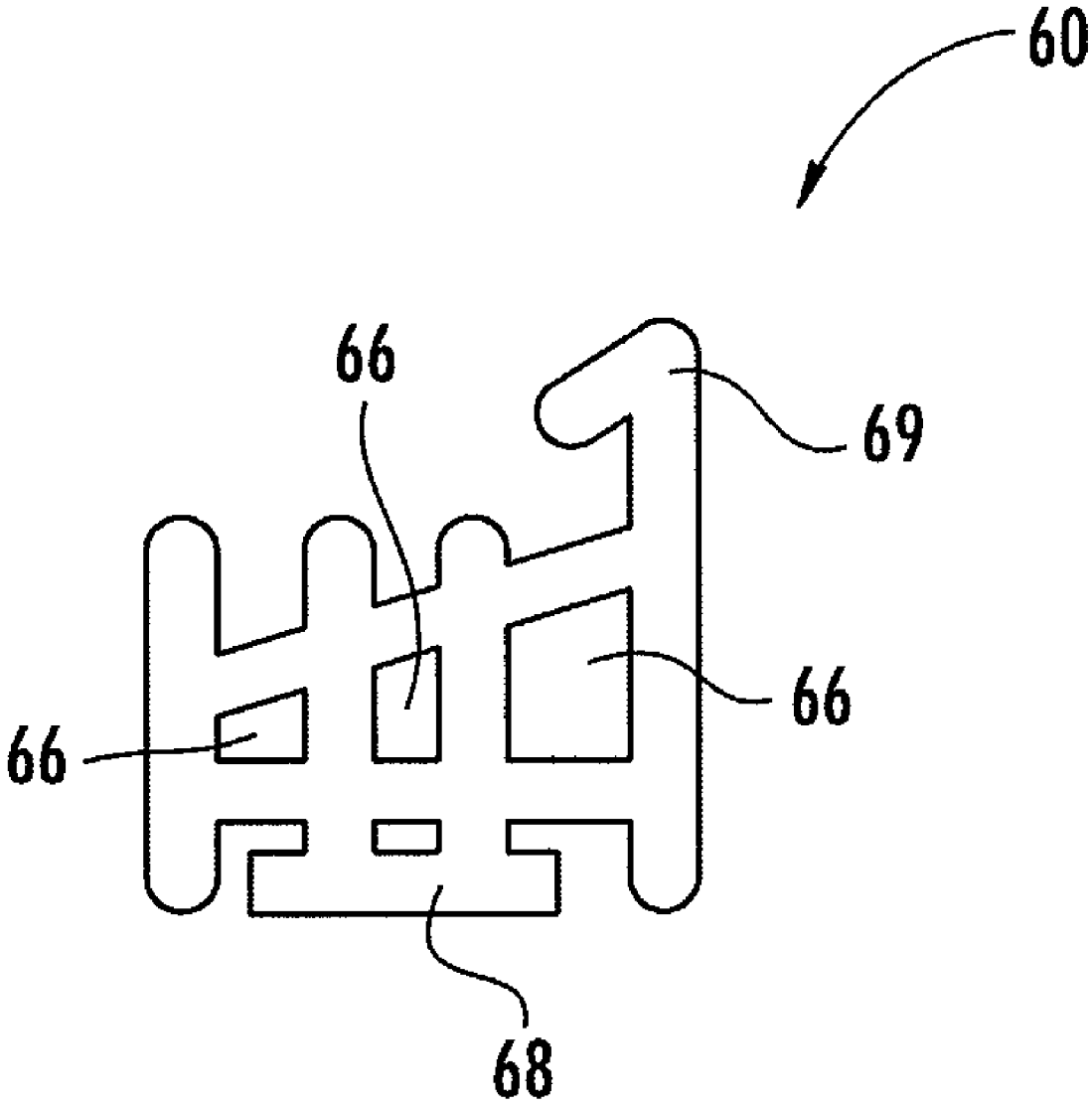

FIG. 6 illustrates an end view of an elongated inner sash insulating element shown in FIG. 2.

Figure 7:
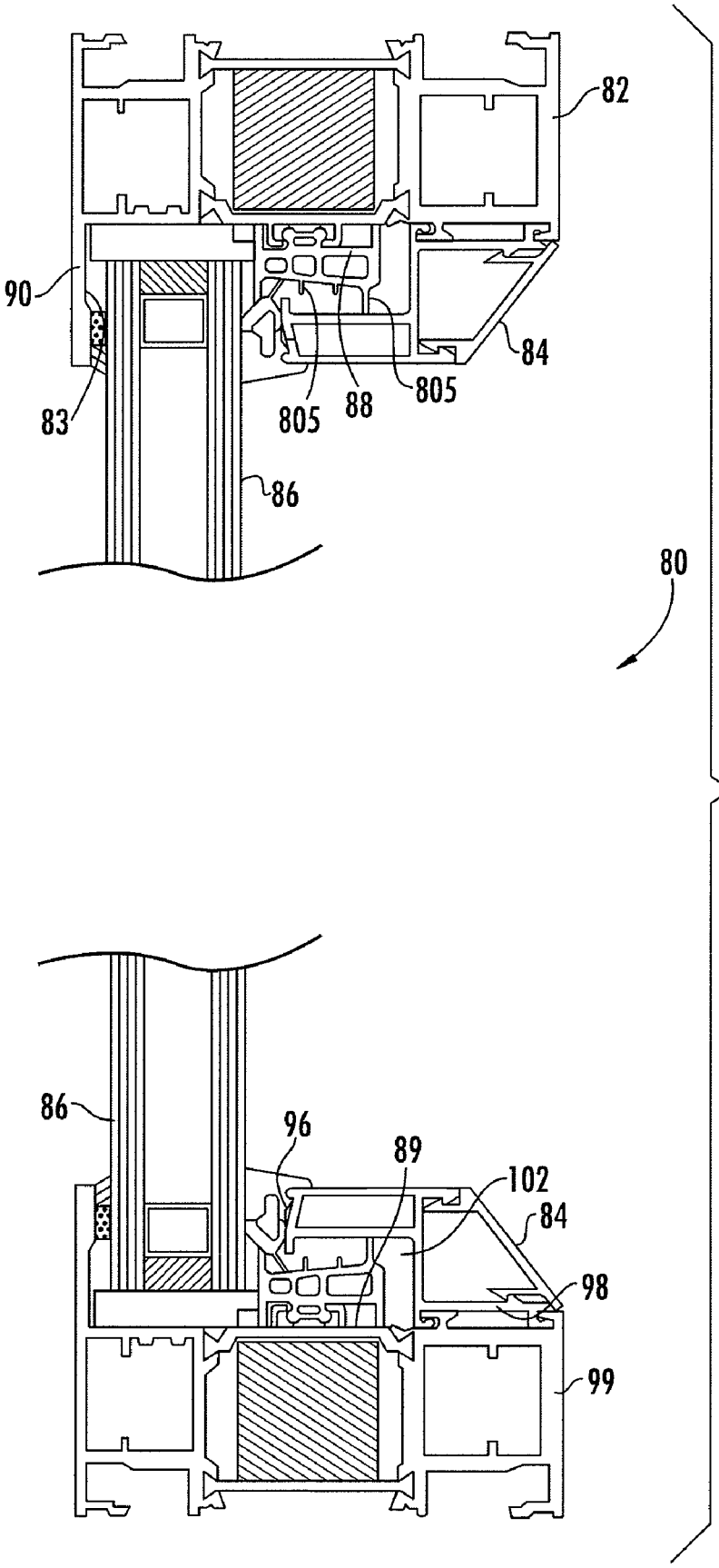

FIG. 7 illustrates a cross sectional view of a fixed frame window assembly according to an alternative embodiment of the invention.

Figure 8:
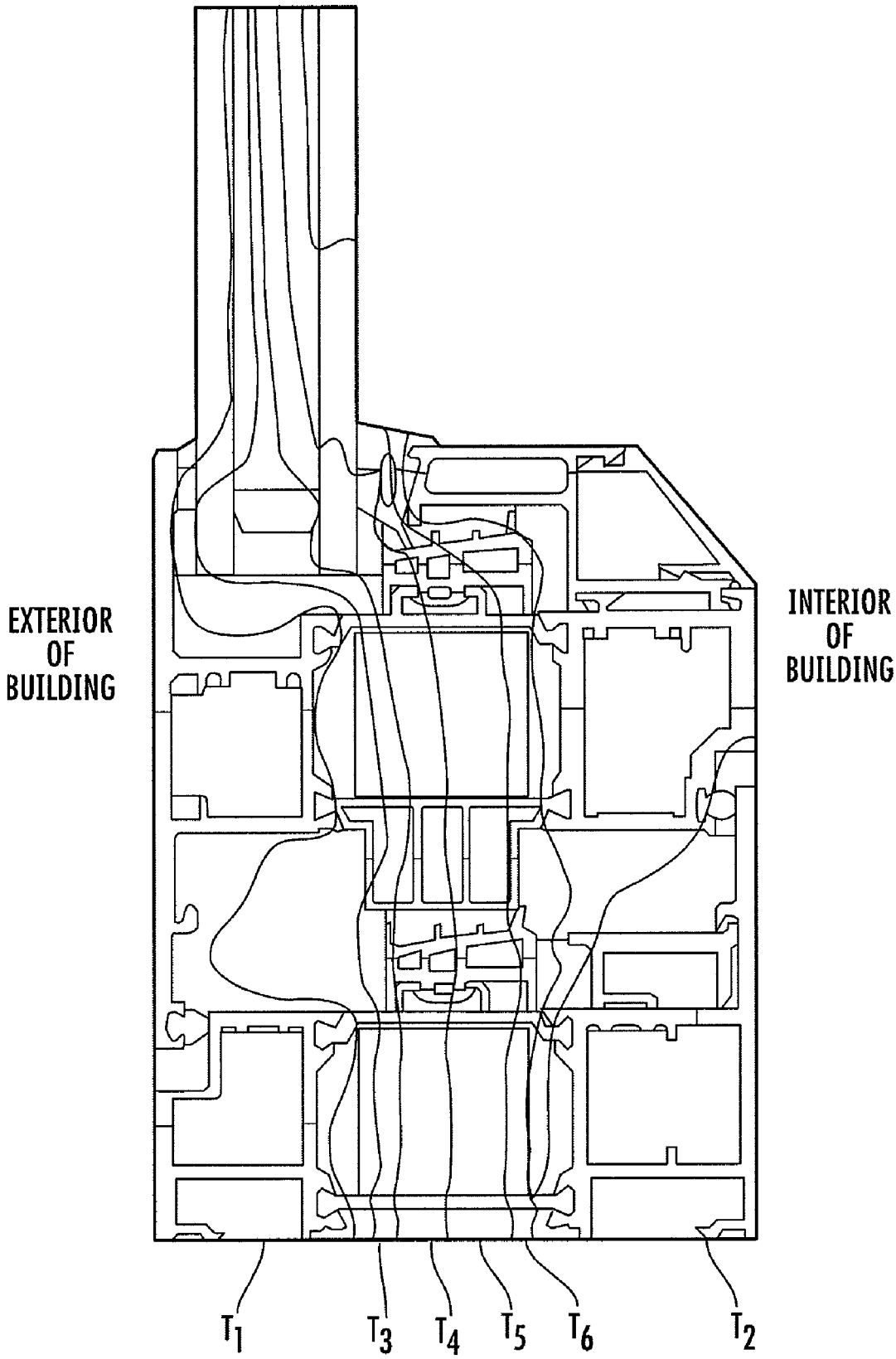

FIG. 8 illustrates a graphical representation of various heat gradients present in the window assembly of FIG. 2 according to one embodiment of the invention.

Figure 9B:
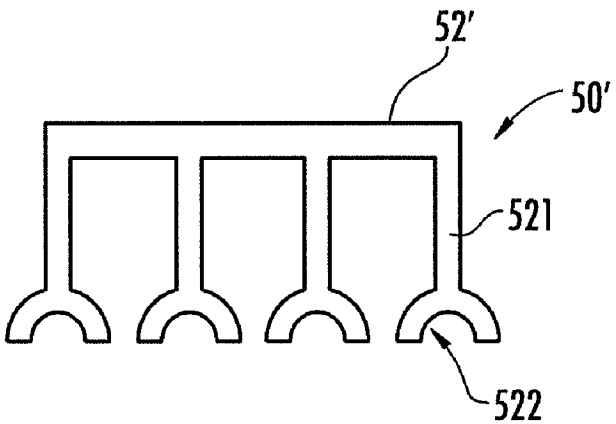
Figure 9A:
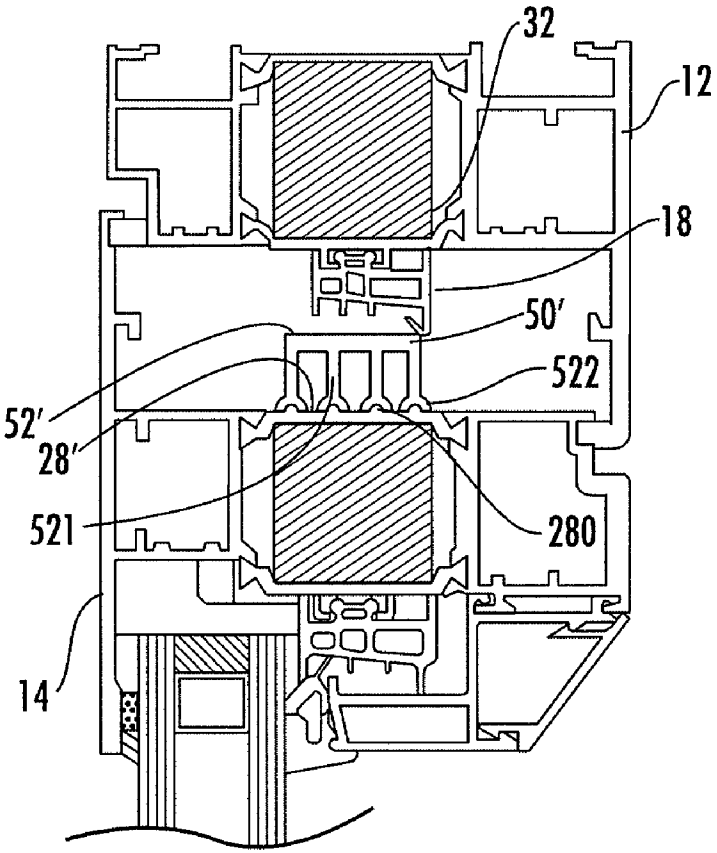

FIG. 9A illustrates a cross sectional view of a window assembly according to an alternative embodiment of the invention.

FIG. 9B illustrates an enlarged view of a portion of the cross-sectional view shown in FIG. 9A.

DETAILED DESCRIPTION OF VARIOUS EMBODIMENTS OF THE INVENTION

Various embodiments of the invention are described more fully hereinafter with reference to the accompanying drawings, in which some, but not all embodiments of the invention are shown in the figures. Indeed, these inventions may be embodied in many different forms and should not be construed as limited to the embodiments set forth herein; rather, these embodiments are provided so that this disclosure will satisfy applicable legal requirements.

FIG. 1 illustrates a perspective view of an operable window assembly 10 in an open position according to one embodiment of the invention, and FIG. 2 illustrates a cross sectional view of the window assembly 10 in a closed position. As shown, the window assembly includes a frame 12, a sash 14 pivotably mounted in the frame, at least one glass panel 16 mounted within the sash 14, a glass stop 40 secured to the sash 14 to prevent movement of the glass panel 16 relative to the sash 14, an elongated frame insulating element 18 disposed on an inner surface 32 of the frame 12 that cofaces an outer surface 28 of the sash 14, an elongated sash insulating element 50 disposed on the outer surface 28 of the sash 14, an elongated inner sash insulating element 60 disposed on an inner surface 30 of the sash 14, and elongated foam members 70 disposed within chambers 39*a*, 27*a* defined within the sash 14 and frame 12, respectively. As shown in FIGS. 3, 4, and 6, the elongated frame insulating element 18, the elongated sash insulating element 50, and the elongated inner sash insulating element 60 each define a plurality of chambers 109, 56, 66, respectively, that extend substantially parallel to a longitudinal axis of each element 18, 50, 60. Chambers 109 and 56 reduce the size of the space between cofacing surfaces of the frame 12 and sash 14, and chamber 66 reduces the size of the space between the sash 14, the glass panel 16, and the glass stop 40, which prevents large convection currents from forming within these spaces, resulting in a more thermally efficient window assembly.

Various embodiments and elements thereof are discussed below in detail.

Frame

FIGS. 1 and 2 illustrate the frame 12 according to one embodiment of the invention. In particular, the frame 12 has an inner surface 32, an outer surface 19, an interior surface 22, and an exterior surface 20. The inner surface 32 and outer surface 19 extend between the interior surface 22 and the exterior surface 20, and the interior surface 22 faces an interior area of a building and the exterior surface 20 faces an exterior area of the building when the window assembly 10 is installed in the building. The outer surface 19 of the frame 12 is disposed adjacent the walls of the building when the window assembly 10 is installed in the building, and the inner surface 32 of the frame 12 is spaced apart from and cofaces an outer surface 28 of the sash 14 when the sash 14 is mounted within the frame 12.

The interior surface 22 of the frame 12 is part of an interior portion 23 of the frame 12, and the exterior surface 20 of the frame 12 is part of an exterior portion 25 of the frame 12. The interior portion 23 and the exterior portion 25 of the frame 12 are each formed from an extruded material, such as aluminum, steel, or other suitable material, and they are joined together via thermal breaks 21. The thermal breaks 21 are formed of a material having low thermal conductivity (e.g., glass fiber, nylon polyamide 6/6 with glass fiber, vinyl, acrylonitrile butadiene styrene (ABS), or rigid polyvinyl chloride (PVC)) relative to the thermal conductivity of the material used to form the frame 12 so as to reduce the heat transferred via conduction between the interior portion 23 and the exterior portion 20 of the frame 12. In addition, in one embodiment, the thermal breaks 21 are formed using an extrusion process. In various embodiments, the length of the thermal breaks between the exterior portion 25 and the interior portion 23 may be chosen based on the material of the frame 12, the material of the thermal break 21, the U-value (or range of U-values) desired for the window assembly 10, and/or the load intended for the frame 12. In a particular embodiment in which the frame 12 material is aluminum and the thermal break 21 material is polyamide 6/6 with glass fiber, the length of the thermal breaks 21 are about 38 mm.

According to one embodiment, the interior portion 23 and the exterior portion 25 of the frame 12 are hollow and each define chambers 27 that extend substantially parallel to the longitudinal axis of the frame 12. In addition, the adjacent surfaces of the thermal breaks 21, the interior portion 23, and the exterior portion 25 also define a chamber 27*a* between them. As shown in FIG. 2, this chamber 27*a* is disposed substantially centrally between the interior surface 22 and the exterior surface 20.

As shown in FIGS. 2 and 5, the inner surface 32 of the frame 12 includes one of the thermal breaks 21*a*, and the thermal break 21*a* defines a track 29 that extends outwardly from the thermal break 21*a* toward the sash 14. The track 29 defines a retaining channel 17 along a longitudinal axis of the track 29. In this embodiment, the track 29 includes a pair of wall portions 29*a* that extend outwardly from the thermal break 21*a* in a substantially perpendicular direction from the thermal break 21*a*, and a pair of flange portions 17*a* that each extend from a distal edge 29*b* of the wall portions 29*a* toward each other and in a substantially parallel direction to the thermal break 21*a*. The distal edges of the flange portions 17*a* define the retaining channel 17.

According to the embodiment shown in FIG. 1, the frame 12 includes a head member 12*a*, a sill member 12*b*, and a pair of jamb members 12*c* forming a substantially rectangular configuration. However, in various other embodiments, the frame 12 may have another type of shape, such as, for example, substantially triangular, substantially circular, substantially oval, or another type of polygonal shape. In addition, in one embodiment, the frame 12 consists of one continuously formed member. However, in other various embodiments, the frame 12 may include two or more extruded members assembled together.

In addition, according to various embodiments, the interior surface 22 of the frame 12 has a greater thickness than the exterior surface 20 of the frame 12. For example, in one embodiment, the thickness of the interior surface 22 of the frame 12 is about 35% greater than the thickness of the exterior surface 20 of the frame 12. By increasing the thickness of the interior surface 22, the interior surface 22 acts as a heat sink during cooler months—storing radiant heat received through the glass panel 16 and any heat transferred to the interior surface 22 through conduction or convection from the exterior surface 20. Because the convection currents in the interior area of the building can be significantly larger than the convection currents that may form in the chambers 27 between the interior surface 22 and the exterior surface 20, less of the heat stored in the interior surface 22 is released to the exterior area of the building. According to one embodiment, this arrangement increases the thermal performance of the window assembly 10 during the cooler months.

Sash

FIGS. 1 and 2 illustrate various elements of the sash 14 according to one embodiment of the invention. In particular, the sash 14 includes an inner surface 30, an outer surface 28, an interior surface 26, and an exterior surface 24. The inner surface 30 and outer surface 28 extend between the interior surface 26 and the exterior surface 24, and the interior surface 26 faces the interior area of the building and the exterior surface 24 faces the exterior area of the building when the window assembly 10 is installed in the building. The outer surface 28 of the sash 14 is spaced apart from and cofaces the inner surface 32 of the frame 12 when the sash 14 is mounted within the frame 12, and the inner surface 30 of the sash 14 is spaced apart from and opposite the outer surface 28.

According to various embodiments, the glass panel 16 is mounted within the sash 14 adjacent its inner surface 30. In particular, the glass panel 16 is mounted adjacent an exterior portion 38 of the sash 14, and the edges of the glass panel 16 are secured within the sash 14 between an inner portion 24*a* of the exterior surface 24 of the sash 14 and a glass stop 40 that is mounted adjacent an interior portion 36 of the sash 14. In various embodiments, the glass panel 16 is an insulating unit that includes two or more glass panels. For example, in a particular embodiment, a conventional insulating unit may be used that includes two panes of ¼" glass, a low e coating, and ½" aluminum box spacer. In addition, in various embodiments, the insulating unit may include an inert gas or other insulating medium between the glass panels of the insulating unit to further increase the thermal efficiency of the window assembly.

In various embodiments, the interior portion 36 and the exterior portion 38 of the sash 14 are each formed from an extruded material, such as aluminum, steel, or other suitable metallic or non-metallic material, and they are joined together via thermal breaks 34. The thermal breaks 34 are formed of a material having low thermal conductivity (e.g., glass fiber, nylon polyamide 6/6 with glass fiber, vinyl, acrylonitrile butadiene styrene (ABS), or rigid polyvinyl chloride (PVC)) relative to the thermal conductivity of the material used to form the sash 14 so as to reduce heat transferred via conduction between the inside portion 36 and the outside portion 38 of the sash 14. In addition, in one embodiment, the thermal breaks 34 are elongated members and are formed using an extrusion process. In various embodiments, the length of the thermal breaks between the exterior portion 38 and the interior portion 36 may be chosen based on the material of the sash 14, the material of the thermal break 34, the U-value (or range of U-values) desired for the window assembly 10, and/or the load intended for the sash 14. In a particular embodiment in which the sash 14 material is aluminum and the thermal break 34 material is polyamide 6/6 with glass fiber, the length of the thermal breaks 34 are about 38 mm.

According to one embodiment, the interior portion 36 and the exterior portion 38 of the sash 14 are hollow and each define chambers 39 that extend substantially parallel to the longitudinal axis of the sash 14. In addition, the adjacent surfaces of the thermal breaks 34, the interior portion 36, and the exterior portion 38 also define a chamber 39*a* between them. As shown in FIG. 2, this chamber 39*a* is disposed substantially centrally between the interior surface 36 and the exterior surface 38.

As shown in FIG. 2, the inner surface 30 of the sash 14 includes one of the thermal breaks 34*a*, and the thermal break 34*a* defines a track 33 that extends outwardly from the thermal break 34*a* in an inward direction of the window assembly 10 (e.g., substantially toward the glass panel 16) the inside of the window assembly 10. The track 33 defines a retaining channel 37 along a longitudinal axis of the track 33. In this embodiment, the track 33 has a shape that is substantially similar to the track 29 shown in FIG. 5.

In addition, as shown in FIG. 2, the outer surface 28 of the sash 14 includes another thermal break 34*b*, and the thermal break 34*b* defines a track 35 that extends outwardly from the thermal break 34*b* in an outward direction of the window assembly 10 (e.g., substantially toward the inner surface 32 of the frame 12 when the sash 14 is installed in the frame 12). The track 35 defines a retaining channel 31 along a longitudinal axis of the track 35, and the track 35 shown in FIG. 2 has a shape that is substantially similar to the track 29 shown in FIG. 5.

According to the embodiment shown in FIG. 1, the sash 14 includes a top rail member 14*a*, a bottom rail member 14*b*, and a pair of stiles 14*c* forming a substantially rectangular configuration. However, in various other embodiments, the sash 14 may have another type of shape, such as, for example, substantially circular, substantially triangular, substantially oval, or another type of polygonal shape. In addition, in one embodiment, the sash 14 may consist of one continuously formed member. In other various embodiments, the sash 14 may include two or more extruded members assembled together.

In addition, according to one embodiment, the interior surface 26 of the sash 14 has a greater thickness than the exterior surface 24 of the sash 14. For example, according to one embodiment, the thickness of the interior surface 26 of the sash 14 is about 20% greater than the thickness of the exterior surface 24 of the sash 14. By increasing the thickness of the interior surface 26, the interior surface 26 acts as a heat sink during cooler months—storing radiant heat received through the glass panel 16 and any heat transferred to the interior surface 26 through conduction and convection from the exterior surface 24. Because the convection currents in the interior area of the building can be significantly larger than the convection currents that may form in the chambers 39 between the interior surface 26 and the exterior surface 24, less of the heat stored in the interior surface 26 is released to the exterior of the building. According to one embodiment, this arrangement increases the thermal performance of the window assembly 10 during the cooler months.

In addition, the embodiment of the sash 14 shown in FIG. 1 is pivotably mounted within the frame 12 such that the sash 14 is pivotable in a direction toward the exterior of the building. However in various other embodiments, the sash 14 may be pivotably mounted within the frame such that the sash 14 is pivotable in a direction toward the interior of the building or slidably mounted within the frame 12.

Glass Stop

As noted above, the embodiment of the glass stop 40 shown in FIG. 2 includes a sash abutting portion 42 and a glass abutting portion 41. The sash abutting portion 42 is configured to be secured adjacent the interior portion 36 of the sash 14. For example, in the embodiment shown in FIG. 2, the inner surface 30 adjacent the interior portion 36 defines a track 30*a*, and the track 30*a* defines a glass stop retaining channel 30*b*. The sash abutting portion 42 of the glass stop 40 includes a hook portion 42*a* that engages the glass stop retaining channel 30*b* and secures the glass stop 40 relative to the sash 14. The sash abutting portion 42 may be slidably engaged into the retaining channel 30*b* or snap fit, for example.

The glass abutting portion 41 is disposed adjacent the glass panel 16 and prevents the glass panel 16 from moving toward the interior portion 36 of the sash 14. To prevent heat transfer through conduction between the glass panel 16 and the glass stop 40, an elongated glass insulating member 43 formed of a material having low thermal conductivity (e.g., silicone, EPDM rubber) relative to the thermal conductivities of the materials used to form the sash 14 or glass panel 16 may be disposed between the glass abutting portion 41 and the glass panel 16.

When mounted to the sash 14, at least a portion of the glass stop 40, an edge of the glass panel 16 disposed between the glass abutting portion 41 and the inner surface 30 of the sash 14, and at least a portion of the inner surface 30 of the sash 14 define a chamber 44 through which convection currents may form.

In one embodiment, the glass stop 40 may be elongated and formed from an extruded material, such as aluminum, steel, or other suitable material. In another embodiment (not shown), the window assembly 10 may include a plurality of glass stops 40 that are spaced apart from each other and disposed along the inner surface 30 of the sash 14.

Frame Insulating Element

FIGS. 1, 2, and 3 illustrate an elongated frame insulating element 18 according to one embodiment of the invention. The elongated frame insulating element 18 is formed separately from the frame 12 from a material having low thermal conductivity relative to the thermal conductivity of the material used to form the frame 12. For example, in one embodiment, the elongated frame insulating element 18 is extruded EPDM rubber, and in another embodiment, the element 18 is extruded silicone. In various other embodiments, the elongated frame insulating element 18 may be formed of other low thermal conductivity materials, such as, for example, the same material used to form the thermal breaks 34*a*, 34*b*, glass fiber, nylon polyamide 6/6 with glass fiber, vinyl, ABS, or rigid PVC.

As shown in FIG. 3, the elongated frame insulating element 18 includes a first surface 101, a second surface 102, a third surface 103, a fourth surface 104, and a frame engaging protrusion 110. The second surface 102 is spaced apart from and opposite the first surface 101, and the third surface 103 and the fourth surface 104 are spaced apart from and opposite each other. In addition, the first and second surfaces 101, 102 extend between the third surface 103 and the fourth surface 104. A plurality of chambers 109 are defined within the elongated frame insulating element 18, and these chambers 109 extend substantially parallel to a longitudinal axis of the elongated frame insulating element 18.

In one embodiment, the fourth surface 104 has a height that is greater than a height of the third surface 103, resulting in a cross sectional shape that is asymmetrical, wherein the cross section is taken through a plane that is substantially perpendicular to the longitudinal axis of the elongated frame insulating element 18, and the cross sectional shape is asymmetrical with respect to a plane extending substantially perpendicular to the first surface 101.

As shown in FIG. 3, the elongated frame insulating element 18 further includes an elongated finger portion 105. The finger portion 105 is disposed adjacent the fourth surface 104 and includes a wall portion 106 that extends outwardly from the second surface 102 (i.e., in a direction away from the first surface 101), a bend 107 at an outward end of the wall portion 102, and a distal end 108 of the finger portion 105 that is disposed closer to the second surface 102 than the bend 107 and extends inwardly from the bend 107 toward the third surface 103. The distal end 108 of the finger portion 105 is slightly biased away from the wall portion 106.

According to a particular embodiment, the frame engaging protrusion 110 extends outwardly from the first surface 101 in a direction away from the second surface 102. The frame engaging protrusion 110 includes a head portion 110*a* at its distal end and a neck portion extending between the head portion 110*a* and the first surface 101. A width of the head portion 110*a* is greater than a width of the retaining channel 17 but less than a width of the track 29, and the a width of the neck portion is less than the width of the head portion 110*a* and the width of the retaining channel 17. This configuration allows the neck portion to be slidably disposed within the retaining channel 17 and the head portion 110*a* to be secured within the track 29.

In addition, according to various embodiments, one or more ribs 112 extend outwardly from the second surface 102 in a direction away from the first surface 101, and the ribs 112 extend longitudinally along at least a portion of the second surface 102. In the embodiment shown in FIG. 3, a first rib 112*a* is disposed adjacent the third surface 103, and two other ribs 112*b*, 112*c* are disposed between the first rib 112*a* and the elongated finger portion 105.

Sash Insulating Element

FIGS. 1, 2, and 4 illustrate an elongated sash insulating element 50 according to one embodiment of the invention. The elongated sash insulating element 50 is formed separately from the sash 14 from a material having low thermal conductivity relative to the thermal conductivity of the material used to form the sash 14. For example, in one embodiment, the elongated sash insulating element 50 is extruded EPDM rubber, and in another embodiment, the element 50 is extruded silicone. In various other embodiments, the elongated frame insulating element 18 may be formed of other low thermal conductivity materials, such as, for example, the same material used to form the thermal breaks 34*a*, 34*b*, glass fiber, nylon polyamide 6/6 with glass fiber, vinyl, ABS, or rigid PVC.

As shown in FIG. 4, the elongated sash insulating element 50 includes a first surface 51, a second surface 52, a third surface 53, a fourth surface 54, and a sash engaging protrusion 55. The second surface 52 is spaced apart from and opposite the first surface 51, and the third surface 53 and the fourth surface 54 are spaced apart from and opposite each other. In addition, the first and second surfaces 51, 52 extend between the third surface 53 and the fourth surface 54. A plurality of chambers 56 are defined within the elongated sash insulating element 50, and these chambers 56 extend substantially parallel to a longitudinal axis of the elongated sash insulating element 50.

In one embodiment, the third surface 53 and the fourth surface 54 have substantially similar heights, resulting in a cross sectional shape that is substantially symmetrical, wherein the cross section is taken through a plane that is substantially perpendicular to the longitudinal axis of the elongated sash insulating element 50, and the cross sectional shape is symmetrical with respect to a plane extending substantially perpendicular to the first surface 51.

According to a particular embodiment, the sash engaging protrusion 55 extends outwardly from the first surface 51 in a direction away from the second surface 52. The sash engaging protrusion 55 includes a head portion 55*a* at its distal end and a neck portion 55*b* extending between the head portion 55*a* and the first surface 51. A width of the head portion 55*a* is greater than a width of the retaining channel 31 but less than a width of the track 35 and the a width of the neck portion 55*b* is less than the width of the head portion 55*a* and the width of the retaining channel 31. This configuration allows the neck portion 55*b* to be slidably disposed within the retaining channel 31 and the head portion 55*b* to be secured within the track 35.

Inner Sash Insulating Element

According to the embodiment shown in FIGS. 2 and 6, the elongated inner sash insulating element 60 has substantially the same cross sectional shape as the frame insulating element 18, which is described above in relation to FIG. 3, wherein the cross section is taken through a plane that is substantially perpendicular to the longitudinal axis of the elongated inner sash insulating element 60. In one embodiment, the elongated inner sash insulating element 60 and the elongated frame insulating element 18 are formed during the same extrusion molding process and are installed on different portions of the window assembly. However, in various other embodiments, the elongated inner sash insulating element 60 may have (1) a cross sectional shape that is substantially the same as the elongated sash insulating element 50 or (2) a cross sectional shape that is different from that of the elongated sash insulating element 50 and the elongated frame insulating element 18 but includes a plurality of chambers defined between its outer surfaces.

In addition, the elongated inner sash insulating element 60 is formed separately from the sash 14 from a material having low thermal conductivity relative to the thermal conductivity of the material used to form the sash 14. For example, in one embodiment, the elongated inner sash insulating element 60 is extruded EPDM rubber, and in another embodiment, the element 60 is extruded silicone. In various other embodiments, the elongated inner sash insulating element 60 may be formed of other low thermal conductivity materials, such as, for example, the same material used to form the thermal breaks 34*a*, 34*b*, glass fiber, nylon polyamide 6/6 with glass fiber, vinyl, ABS, or rigid PVC.

Foam Members

According to the embodiment shown in FIG. 2, the elongated foam members 70 are formed of a material having low thermal conductivity (e.g., polyisocyanurate unfaced insulation board) relative to the thermal conductivity(s) of the material(s) used to form the frame 12 and sash 14 and have a generally rectangular cross sectional shape as taken through a plane extending substantially perpendicular to a longitudinal axis of each foam member 70. However, in various embodiments, the cross sectional shape may be circular, triangular, or another suitable polygonal shape.

Assembly and Operation of Window

FIGS. 1 and 2 show the various elements of the operable window assembly 10 assembled together. As described above, the glass panel 16 is secured within the sash 14 by mounting the glass stop 40 to the sash 14 such that the sash abutting portion 42 is disposed adjacent the interior portion 36 of the sash 14 and the glass abutting portion 41 is disposed adjacent an edge of the glass panel 16 on an interior side of the glass panel 16. In addition, the inner portion 24*a* of the exterior surface 24 of the sash 14 is disposed adjacent the edge of the glass panel 16 on an exterior side of the glass panel 16.

In addition, the elongated foam members 70 are slidably disposed within the central chamber 27*a* of the frame 12 and the central chamber of the sash 39*a*. In the embodiment shown in FIG. 2, the elongated foam members 70 are dimensioned to fit tightly within the chambers 27*a*, 39*a*, which reduces the amount of available space in the chambers 27*a*, 39*a* in which convection currents could form.

In addition, the frame engaging protrusion 110 of the elongated frame insulating element 18 is slidably disposed within the retaining channel 17 of the frame 12 such that the elongated frame insulating element 18 is disposed adjacent the inner surface 32 of the frame 12 and the finger portion 105 is disposed adjacent an interior portion 23 of the frame 12. In one embodiment, the elongated frame insulating element 18 is one piece and extends the entire perimeter of the inner surface 32. In various other embodiments, the elongated frame insulating element 18 includes two or more separate pieces (e.g., formed separately, or formed from the same extrusion process and then cut into separate pieces). In a particular embodiment, the pieces include a first piece, a second piece, a third piece, and a fourth piece. The first piece is disposed adjacent the inner surface 32 of the head member 12*a*, the second piece is disposed adjacent the inner surface 32 of the sill member 12*b*, the third piece is disposed adjacent the inner surface 32 of one of the jamb members 12*c*, and the fourth piece is disposed adjacent the inner surface 32 of the other jamb member 12*c*. In a further embodiment, one or more of the pieces include mitered or cut-out portions at one or both of their ends to allow the end of the piece to abut an adjacent piece more closely.

Similarly, an inner sash engaging protrusion 68 of the elongated inner sash insulating element 60 is slidably disposed within the retaining channel 37 of the sash 14 such that the elongated inner sash insulating element 60 is disposed adjacent the inner surface 30 of the sash 14 and a finger portion 69 of the elongated inner sash insulating element 60 is disposed adjacent the interior portion 36 of the sash 14. In one embodiment, the finger portion 69 engages a portion of the glass stop 40, preventing the flow of air past the finger portion 69. According to one embodiment, the use of the elongated inner sash insulating element 60 reduces the size of the convection currents that can form in the chamber 44 defined between the glass stop 40, the glass panel 16, and the inner surface 30 of the sash 14.

In addition, in one embodiment, the elongated inner sash insulating element 60 is one piece and extends the entire perimeter of the inner surface 30. In various other embodiments, the elongated inner sash insulating element 60 includes two or more separate pieces (e.g., formed separately, or formed from the same extrusion process and then cut into separate pieces). In a particular embodiment, the pieces include a first piece, a second piece, a third piece, and a fourth piece. The first piece is disposed adjacent the inner surface 30 of the top rail 14*a*, the second piece is disposed adjacent the inner surface 30 of the bottom rail 14*b*, the third piece is disposed adjacent the inner surface 30 of one of the stiles 14*c*, and the fourth piece is disposed adjacent the inner surface 30 of the other stile 14*c*. In one embodiment, one or more of the pieces may include mitered or cut-out portions at one or both of their ends to allow the end of the piece to abut an adjacent piece more closely.

Likewise, the sash engaging protrusion 55 of the elongated sash insulating element 50 is slidably disposed within the retaining channel 31 of the sash 14 such that the elongated sash insulating element 50 is disposed adjacent the outer surface 28 of the sash 14. In one embodiment, the elongated sash insulating element 50 is one piece and extends the entire perimeter of the outer surface 28. In various other embodiments, the elongated sash insulating element 50 includes two or more separate pieces (e.g., formed separately, or formed from the same extrusion process and then cut into separate pieces). In a particular embodiment, the pieces include a first piece, a second piece, a third piece, and a fourth piece. The first piece is disposed adjacent the outer surface 28 of the top rail 14*a*, the second piece is disposed adjacent the outer surface 28 of the bottom rail 14*b*, the third piece is disposed adjacent the outer surface 28 of one of the stiles 14*c*, and the fourth piece is disposed adjacent the outer surface 28 of the other stile 14*c*.

The above embodiments describe each of the elongated frame insulating element 18, the elongated sash insulating element 50, and the elongated inner sash insulating element 60 as having a male engaging portion (e.g., protrusions 110, 55, 68) that engages a female engaging portion (e.g., tracks 29, 33, 35) of the frame 12 or sash 14. However, in alternative embodiments (not shown), the elongated frame insulating element 18, the elongated sash insulating element 50, and/or the elongated inner sash insulating element 60 may include one or more female engaging portions that are each configured for slidably receiving a corresponding male engaging portion that extends from a surface of the frame 12 or sash 14. For example, as shown in FIGS. 9A and 9B, the elongated sash insulating element 50 defines a second surface 52 from which four ribs 521 extend in a substantially perpendicular direction to the second surface 52. Each rib 521 defines a channel 522 at a distal end thereof. The outer surface 28 of the sash 14 includes four protrusions 280 that extend outwardly from the outer surface 28 toward the inner surface 32 of the frame 12. Each of the channels 522 are configured to slidably receive the protrusions 280 from the outer surface 28 of the sash 14 to secure the elongated sash insulating element 50 adjacent to the outer surface 28 of the sash 14. In addition, each of the ribs 521, the second surface 52 of the elongated sash insulating element 50, and the outer surface 28 of the sash 14 defines three chambers for reducing convection currents.

As noted above, the sash 14 shown in FIGS. 1 and 2 is pivotably mounted to the frame 12 adjacent the top rail 14*a* of the sash 14, allowing the sash 14 to pivot outwardly toward the exterior area of the building, as shown in FIG. 1, or pivot in the opposite direction to a closed position, as shown in FIG. 2. When the sash 14 is in the closed position, the second surface 102 of the elongated frame insulating element 18 is disposed in a cofacing and spaced apart relationship with the second surface 52 of the elongated sash insulating element 50. In some embodiments, one or more of the ribs 112 of the second surface 102 may also engage the second surface 52 when the sash 14 is in the closed position. In particular, according to one embodiment, the asymmetrical shape of the frame insulating element 18 allows for variations in the distance between the inner surface 32 of the frame 12 and the outer surface 28 of the sash 14 without giving up thermal performance. Furthermore, in the embodiment shown in FIG. 2, the finger portion 105 of the elongated frame insulating element 18 is biased against the fourth surface 54 of the elongated sash insulating element 50, creating a more positive seal against air flow. The chambers 109, 56 formed in these insulating elements 18, 50 (and any engagement of portions of the second surfaces 102, 52) reduce the size of the space between the outer surface 28 of the sash 14 and the inner surface 32 of the frame 12, which reduces the size of the convention currents that can form in the space between the sash 14 and the frame 12.

Of course, various other embodiments may include slidably disposing an asymmetrically shaped insulating element on the outer surface 28 of the sash 14 and a symmetrically shaped insulating element on the inner surface 32 of the frame 12. Alternatively, various embodiments may include slidably disposing asymmetrically shaped insulating elements on both the outer surface 28 of the sash 14 and the inner surface 32 of the frame 12. And, in yet another embodiment, symmetrically shaped insulating elements may be slidably disposed on both the outer surface 28 of the sash 14 and the inner surface 32 of the frame 12.

In various embodiments, such as those described above in relation to FIGS. 1-6, the elongated insulating elements are manufactured from one or more elastomeric materials, such as EPDM rubber or silicone. However, in other various embodiments, one or more of the elongated insulating elements may be made of a rigid material, such as glass fiber, nylon polyamide 6/6 with glass fiber, vinyl, ABS, or rigid PVC, and in a particular embodiment, the elongated insulating elements may be integrally formed with a thermal break. For example, in the embodiment shown in FIGS. 9A and 9B, the elongated sash insulating element 50 is manufactured from a rigid material and the elongated frame insulating element 18 is manufactured from an elastomeric material. In yet another embodiment (not shown), the elongated frame insulating element 18 is manufactured from a rigid material and the elongated sash insulating element 50 is manufactured from an elastomeric material. And, in another alternative embodiment, the elongated frame insulating element 18 and the elongated sash insulating element 50 may be formed of a rigid material.

FIG. 8 illustrates thermal gradients between the interior and exterior portions of the embodiment of the window assembly 10 shown in FIG. 2 when the temperature of air inside the building (i.e., the interior area of the building) is 70° F. and the temperature of the air outside of the building (i.e., the exterior area of the building) is 0° F. As shown in this embodiment, each thermal gradient T1-T6 forms a substantially vertical wall through the window assembly 10, illustrating that the flow of air between the interior and the exterior of the window assembly 10 is substantially stopped. Substantially stopping the flow of air within the window assembly 10 reduces (or prevents) heat from being transferred via convection. In particular, the exterior portions 25, 38 of the frame 12 and sash 14 and the air therein have a first temperature T1, and the interior portions 23, 36 of the frame 12 and sash 14 and the air therein have a second temperature T2, wherein T1 and T2 are different when the temperature of the air inside the building is different from the temperature of the air outside the building. In the embodiment shown in FIG. 8, the temperatures T3-T6 of the portions of the window assembly 10 between the interior portions 23, 36 and the exterior portions 25, 38 of the window assembly 10 range between T1 and T2.

According to various embodiments, the thermal performance of a window assembly, such as the window assembly 10 described above in relation to FIG. 2, can be improved to a U-value (measure of thermal transmittance) of about 0.34 to about 0.35, as compared to a U-value of 0.4 to about 0.45 for conventional window assemblies. In addition, according to one embodiment, a high (or higher) performance insulating unit may be used instead of conventional insulating units or conventional monolithic glass to improve the U-value further. For example, high performance insulating units may use warm edge spacers, high performance coatings, and/or additional glass panes.

FIG. 7 illustrates a fixed frame window assembly 80 according to an alternative embodiment of the invention. The fixed frame window assembly 80 includes an insulating unit 86, a frame 82, a glass stop 84, and an elongated frame insulating member 88. The edges of the insulating unit 86 are disposed adjacent an inner surface 89 of the frame 82 between an inner portion 83 of an exterior surface 90 of the frame 82 and a glass abutting portion 96 of the glass stop 84. A frame abutting portion 98 of the glass stop 84 is disposed adjacent an interior portion 99 of the frame, similar to the embodiments described above in relation to FIG. 2. The elongated frame insulating member 88 is slidably disposed in a chamber 102 adjacent the inner surface 89 of the frame, wherein the chamber 102 is defined by the edges of the insulating unit 86, at least a portion of the glass stop 84, and at least a portion of the inner surface 89 of the frame 82. As noted above in relation to the embodiments shown in FIGS. 1-6 and 9A-9B, the elongated frame insulating member 88 according to the embodiment shown in FIG. 7 includes a male engaging portion for engaging a female receiving portion defined on the surface of the frame 82. However, in an alternative embodiment (not shown), the elongated frame insulating member 88 may include a female engaging portion for receiving a male engaging portion extending from the surface of the frame.

According to various embodiments, the elongated frame insulating element 88 shown in FIG. 7 has many of the same features as the elongated frame insulating element 18 described above in relation to FIG. 3. For example, the element 88 may be formed from the same materials as the element 18 and/or using the same manufacturing methods. In addition, the element 88 may have substantially the same cross-sectional shape as the element 18 shown in FIG. 3. However, in one particular embodiment, which is shown in FIG. 7, the element 88 does not include a finger portion 105 as described above in relation to the element 18, but includes a plurality of ribs 805 that extend upwardly from a second surface 102. At least one of the ribs 805 engages the glass stop 84, preventing the flow of air between the insulating unit 86 and the frame abutting portion 98 of the glass stop 84. According to one embodiment, the U-value of the window assembly 80 shown in FIG. 7 has a U-value of about 0.33.

Furthermore, window assemblies made from aluminum or other metals having relatively high thermal conductivity are prone to "sweating" in the cooler months due to condensation resulting from heat transferred through the window assembly. According to various embodiments, reducing the amount of heat transferred through the window assembly results in an improved condensation resistance factor (CRF) for the window assembly. For example, window assemblies like the embodiments described above in relation to FIGS. 1-8 may have a CRF of the frame in the range of about 76 to about 79, as compared to conventional window assemblies which have a CRF of the frame in the range of 60 to 64.

CONCLUSION

Although this invention has been described in specific detail with reference to the disclosed embodiments, it will be understood that many variations and modifications may be effected within the spirit and scope of the invention as described in the appended claims.

The invention claimed is:

1. A window assembly comprising:

a. a glass panel, a sash extending around the glass panel, and a frame extending around the sash;

b. wherein the frame comprises an inner frame portion configured to face an interior of a building, an outer frame portion configured to face an exterior of the building, and a frame insulating portion separating and spacing the inner frame portion from the outer frame portion, wherein the inner and outer frame portions comprise a relatively high thermal conductivity and the frame insulating portion comprises a relatively low thermal conductivity;

c. wherein the sash comprises an inner sash portion configured to face the interior of the building, an outer sash portion configured to face the exterior of the building, and a sash insulating portion separating and spacing the inner sash portion from the outer sash portion, wherein the inner and outer sash portions comprise a relatively high thermal conductivity and the sash insulating portion comprises a relatively low thermal conductivity;

d. a glass stop extending along an inner surface of the sash, the glass stop configured to retain the glass panel in the window assembly, wherein the glass stop is separated from the glass panel by a glass insulating member, wherein the glass stop, the glass insulating member, and the sash at least partially define a cavity, wherein a sash insulating element comprising a plurality of longitudinally extending chambers extends through the cavity, around an entire perimeter of the sash, and extends between and abuts the sash insulating portion and the glass stop;

e. wherein an inner surface of the frame faces an outer surface of the sash;

f. wherein a frame insulating element having a relatively low thermal conductivity extends along an entire perimeter of the inner surface of the frame and a second sash insulating element having a relatively low thermal conductivity extends along an entire perimeter of the outer surface of the sash;

g. wherein the glass panel, glass insulating member, frame insulating portion, sash insulating portion, frame insulating element, sash insulating element and second sash insulating element are part of a conductive and convective thermal barrier continuously separating the inner frame and sash portions from the outer frame and sash portions.

2. The window assembly of claim 1, wherein the frame insulating portion comprises two frame thermal breaks and a frame foam member, wherein the two frame thermal breaks extend between the exterior and interior portions of the frame and define a frame cavity, wherein the frame foam member extends through the frame cavity and abuts the two frame thermal breaks.

3. The window assembly of claim 2, wherein the sash insulating portion comprises two sash thermal breaks and a sash foam member, wherein the two sash thermal breaks extend between the exterior and interior portions of the sash and define a sash cavity, wherein the sash foam member extends through the sash cavity and abuts the two sash thermal breaks.

4. The window assembly of claim 1, wherein the frame and second sash insulating elements each comprises a plurality of longitudinally extending chambers.

5. The window assembly of claim 4, wherein at least one of an inner surface of the frame insulating element and an outer surface of the second sash insulating element comprises a finger extending therefrom.

6. The window assembly of claim 5, wherein the inner surface of the frame insulating element and the outer surface of the second sash insulating element each comprise a plurality of ribs extending therefrom.

7. The window assembly of claim 1, wherein the inner and outer frame and sash portions each define a plurality of extruded walls.

8. The window assembly of claim 7, wherein the extruded walls of the inner frame and sash portions are thicker than the extruded walls of the outer frame and sash portions.

9. A window assembly, comprising:

a. a glass panel and a frame extending around the glass panel;

b. wherein the frame comprises an inner frame portion configured to face an interior of a building, an outer frame portion configured to face an exterior of the building, and a frame insulating portion separating and spacing the inner frame portion from the outer frame portion, wherein the inner and outer frame portions comprise a relatively high thermal conductivity and the frame insulating portion comprises a relatively low thermal conductivity;

c. a glass stop extending along an inner surface of the frame, the glass stop configured to retain the glass panel in the window assembly;

d. wherein a glass insulating member separates the glass stop from the glass panel, wherein the glass stop has a relatively high thermal conductivity and the glass insulating member has a relatively low thermal conductivity;

e. wherein the glass panel, the frame insulating portion, and the glass insulating member are part of a conductive and convective thermal barrier continuously separating the inner frame portion from the outer frame portion; and f. wherein the glass stop, glass insulating member, and the inner surface of the frame at least partially define a cavity, and wherein a frame insulating member having a plurality of longitudinally extending chambers extends through the cavity around an entire perimeter of the frame and extends between and abuts the frame insulating portion and the glass stop, wherein the frame insulating member is part of the conductive and convective thermal barrier continuously separating the inner frame portion from the outer frame portion.

10. The window assembly of claim 9, wherein the frame insulating portion comprises two frame thermal breaks and a frame foam member, wherein the two frame thermal breaks extend between the exterior and interior portions of the frame and define a frame cavity, wherein the frame foam member extends through the frame cavity and abuts the two frame thermal breaks.

11. The window assembly of claim 9, wherein the inner and outer frame portions each define a plurality of extruded walls.

12. The window assembly of claim 11, wherein the extruded walls of the inner frame portion are thicker than the extruded walls of the outer frame portion.

13. The window assembly of claim 9, wherein an inner surface of the frame insulating member comprises a finger extending therefrom.

14. The window assembly of claim 13, wherein the inner surface of the frame insulating member comprises a plurality of ribs extending therefrom.

* * * * *